US006116248A

United States Patent [19]

Walker

[11] Patent Number: 6,116,248

[45] Date of Patent: Sep. 12, 2000

[54] THUMB AND FINGERNAIL POLISH REMOVER DEVICE

[76] Inventor: Alvin M. Walker, 143 Lake Shore Dr. North, Palm Harbor, Fla. 34684

[21] Appl. No.: 09/487,301

[22] Filed: Jan. 19, 2000

[51] Int. Cl.[7] ..... A45D 29/18

[52] U.S. Cl. ..... 132/74.5; 132/76.4; 15/167.3

[58] Field of Search ..... 132/73, 74.5, 73.6, 132/75.8, 76.4; 15/167.3

[56] References Cited

U.S. PATENT DOCUMENTS

| | | | |
|---|---|---|---|
| 2,424,509 | 7/1947 | Singer | 132/73 |
| 2,629,124 | 2/1953 | Merritt | 132/73 |
| 3,966,335 | 6/1976 | Abramson | 15/167.3 |
| 5,065,778 | 11/1991 | Terrell | 132/74.5 |
| 5,609,166 | 3/1997 | Walker | 132/73 |
| 5,810,021 | 9/1998 | Walker | 132/74.5 |
| 5,823,203 | 10/1998 | Carroll et al. | 132/74.5 |

*Primary Examiner*—Todd E. Manahan
*Attorney, Agent, or Firm*—John S. Hale; Gipple & Hale

[57] ABSTRACT

A nail polish remover device adapted for removing fingernail polish from all the fingers and thumb on a hand comprising a cylindrical receptacle defining a chamber with a brush insert assembly mounted within the chamber. The brush insert assembly defines a plurality of finger holes with adjacent semicylindrical support members to receive bristle members which are mounted in the semicylindrical support members allowing the finger and thumb of a user to remove nail polish from the users fingernails.

19 Claims, 3 Drawing Sheets

FIG. 2
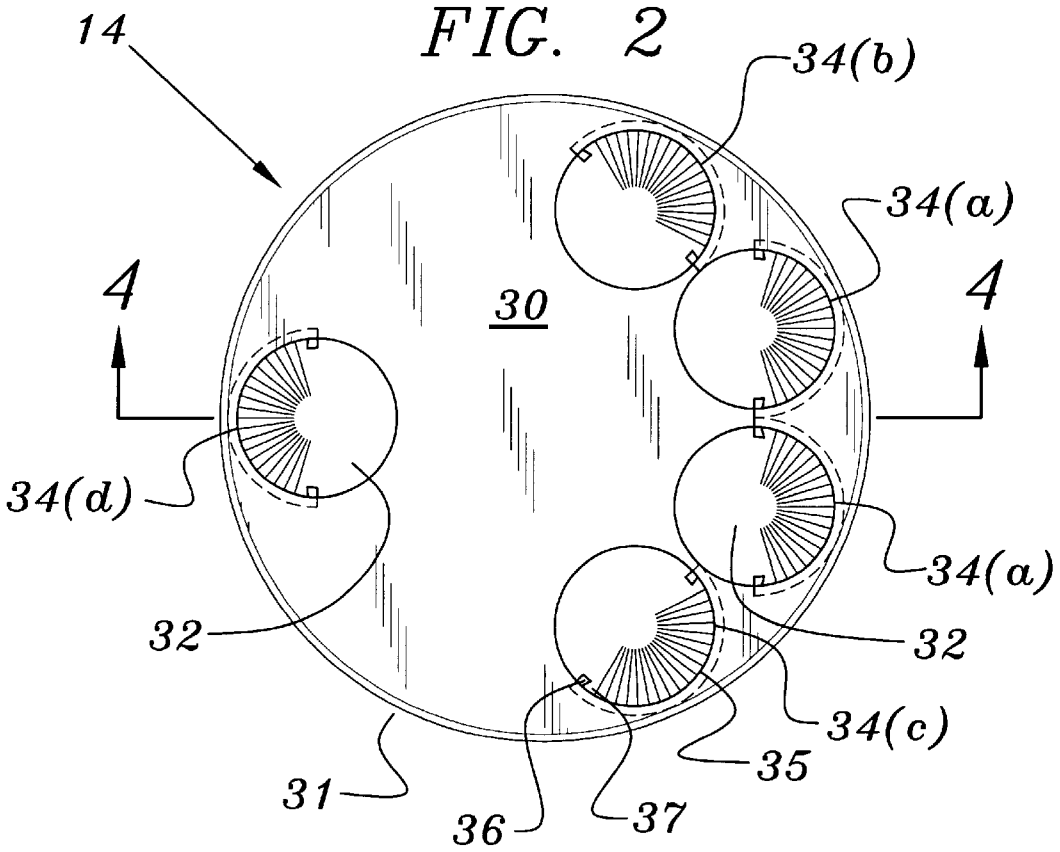
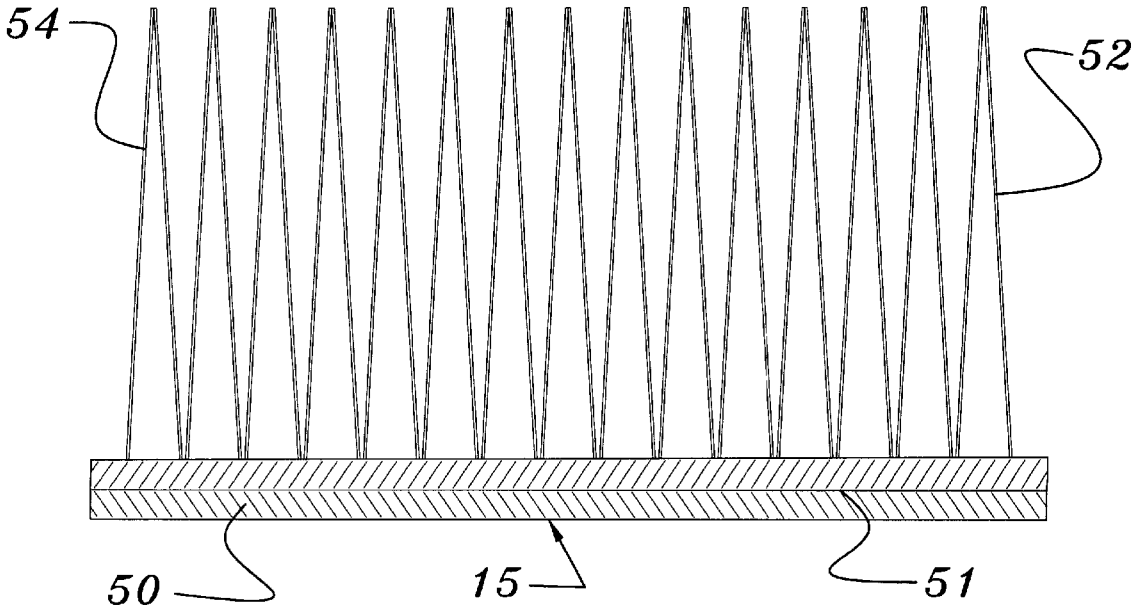
FIG. 3

THUMB AND FINGERNAIL POLISH REMOVER DEVICE

BACKGROUND OF THE INVENTION

1. Field of Invention

The present invention relates to devices for removing fingernail polish and in particular is directed towards a molded container with an insert having insertable one piece molded member with individual semicylindrical finger and thumb brush retainer and support members. Each brush retainer and support member holds a bristle assembly for removing fingernail polish simultaneously from the thumb and fingers of either hand.

2. Description of the Prior Art

The prior art contains many references directed to nail polish removal receptacles which support or suspend an insert structure to aid in the removal of hardened nail polish from fingernails after a finger has been immersed in nail polish remover contained within the receptacle. U.S. Pat. Nos. 4,474,195; 4,440,181; and 4,282,891 disclose nail polish remover devices in which a receptacle is provided with a sponge or sponge-like absorbent member insert. The sponge member insert is formed with an aperture forming a finger hole into which the finger is placed. The absorbent sponge absorbs nail polish remover and upon insertion of the finger into the sponge aperture, the polished fingernail comes into contact with the sponge and nail polish remover solution to remove the polish from the nail. The solution and polish fragments are wiped from the inserted fingernail by the sponge as the fingernail is removed from the receptacle jar. A multi-layer foam surgical scrub sponge similar to those shown in the patents noted above is disclosed by U.S. Pat. No. 4,866,806. In this reference a removable serrated insert is accommodated in the center of the sponge to enable insertion of the fingers to cleanse and disinfect the cuticle areas.

U.S. Pat. No. 4,480,351 discloses a surgical scrub brush provided with two sets of brushes in each side of the molded container body. The brush bristles are formed with a configuration of smaller bristles disposed in a longitudinal channel or gap between taller bristle groups whose tips are laterally exposed to facilitate nail cleaning. The individual bristle members have a triangular cross-section.

Another surgical scrub brush is shown in U.S. Pat. No. 3,966,335. This patent features four bristle-lined troughs for simultaneous scrubbing of the four fingers. Rows of relatively short stiff bristles are used for cleaning the finger tips, nails, and under the nails.

U.S. Pat. No. 4,397,324 discloses a nail polish receptacle which is provided with a brush member disposed in the receptacle by wire legs which support the brush element in the approximate determines of a circular finger opening. Similarly, U.S. Pat. No. 4,321,936 discloses a nail polish remover receptacle containing a plurality of downwardly spaced apart free floating legs with an inwardly curved end portion. The legs have bristles or brush like elements secured thereto which extend inward. When a person inserts a finger into the device, the finger will contact the bristles and push the legs outward in such a manner that the nail polish remover liquid on the bristles will remove the nail polish from the fingernails. U.S. Pat. No. 3,316,922 discloses a nail polish remover device in which a circular brush with a circular open center is mounted on a group of abutments extending inwardly from an insert surface. The brush member is positioned on the abutments and the brush stem is moved against the abutments to snap into an inclined position. In U.S. Pat. No. 2,771,621 a reciprocating spring braced member carries a brush head with bristles extending into a recess into which a finger is placed to remove the nail polish.

U.S. Pat. Nos. 5,048,547 and 4,819,672 issued to the present inventor disklose a cylindrical housing holding a one piece brush assembly which has inwardly projecting integral triangular shaped bristles configured to receive a finger and remove the fingernail polish.

U.S. Pat. No. 5,855,212 also issued to the present inventor discloses an insert having four finger recesses and two thumb recesses with brush members integrally formed across from the respective finger and thumb recesses. The insert is mounted within the chamber of the cylindrical receptacle.

A number of patents are directed toward simultaneously cleaning the thumb and fingernails of a hand to remove the polish by brushing the same in an acetone bath. In U.S. Pat. No. 4,476,883, an U-shaped container assembly is disclosed for applying a predetermined liquid or solution to the fingernails of a person. A sponge material is disposed in the interior of a housing and is provided with a plurality of recesses dimensioned and configured to receive the fingertip and the fingernail of the user in a predetermined array facilitating placement of all the fingers and thumbs in the various recesses. A liquid or solution is applied to the interior of the housing and the sponge material and the housing is filled to a level sufficient to form small pools in the bottom of each of the finger recesses.

U.S. Pat. No. 5,823,203 discloses a nail polish remover container with a flexible strip of high density polyurethane which is coiled around the inner cylindrical wall of the inner receptacle. The brush strip is seated on an upwardly facing ledge formed on the inner receptacle which is in turn nested within the outer housing of the container. The top of the brush strip is held in place by a skirt member which is frictionally press fit against the top portion of the inner cylindrical wall of the inner receptacle.

A spherical shaped finger support and locating device guides the fingers and thumb of the user against the brush strip.

Another thumb and finger cleaner, U.S. Pat. No. 5,065,778 discloses a fingernail polish removing container with a base, and a lid, and a fingernail scrubbing structure mounted within the container in spaced relation to the container base bottom wall and to the lid top wall. In some of the disclosed embodiments the fingernail scrubbing structure is supported within the container base, and includes five finger bore openings, four of which are of substantially equal diameter with the center points located on the circumference of a circle with the fifth bore opening being positioned closer to the center point of the circle. This thumb tip receiving opening is of greater diameter than the other four finger openings and displaced closer to the center point of the fingernail scrubbing structure to receive simultaneously the fingernails of the fingers and thumb of one hand. The finger bore openings are provided with sponge inserts which are seated on a bottom circular step formed around the base of the cylindrical members which are axially aligned with the finger bore openings. The sponge inserts remove nail polish from the nails, and the nail polish removing liquid is sloshed between the bottom and the upper chambers to saturate the finger bore opening wall surfaces.

It can thus be seen that the aforenoted patents do not teach or disclose the present invention which utilizes a molded container having an insert formed with finger holes and adjacent downwardly projecting semicylindrical support members. Individual bristle liners are inserted into the semicylindrical support member which form a arcuate brush pattern providing a simple means of removing nail polish from the thumb nail and fingernails of each hand in a clean environment relatively free of bacteria and virus. Many of the above cited patents use sponge or sponge-like product to apply nail polish remover to the fingernails. There are health reservations about the use of sponge product in beauty salons because of the occurrence of bacterial collection and growth in the sponge.

SUMMARY OF THE INVENTION

The present invention provides for a unique injection molded nail cleaning apparatus receptacle which provides for an improved fingernail cleaning and conditioning, through the use of an insert having individual insertable brush bristle liner members which are mounted next to the finger holes. The device is made of three separate injection molded components: the container, the brush holder insert assembly which is provided with five vertical semicylindrical brush supports, each of which is provided with inwardly angled end flanges to hold individual brush bristle liner members in place and a cap. The brush holder insert can be snap fit in the container or friction welded onto the top portion of the container. Each brush or bristle liner member is molded flat then bent into a semicircular configuration to fit into the semicylindrical brush supports extending downward from the top disk member.

It is an object of the invention that the bristle sections provides maximum contact with the fingernails and thumbnail when the fingers and thumb are inserted into the interior of the polish remover container. Each brush bristle section has spaced bristle rows which are separated to allow a constant flow of nail polish remover or conditioner into the brushing area during the brushing period and continuous circulation of the liquid throughout the container.

It is another object of the invention that the container is disposable, thus preventing the bacterial or viral growths which occur in presently used fingernail cleaning containers as well as disposing of any cuticle material that has been torn or pulled off by the bristles. Presently most fingernail cleaning containers are reused with the user simply adding new acetone into the container. Proper sterilization and hygiene are of the utmost importance to the cosmetology industry and to the individual retail consumer. Cleanliness is of particular importance if the soft tissue surrounding the fingernail, especially the cuticle area, is open and bleeding. This frequently occurs due to job related tearing of the cuticles or from habitual fingernail biting. Such open wound areas are frequently sources for the transmission of dangerous pathogens such as bacterial, fungi, and viruses. It is possible that this could be a pathway for the transmission of acquired immune deficiency syndrome (AIDS) if several people use the same container or if bacterial colonies are allowed to flourish in an old container.

Another important objective of the present inventive nail polish remover device is to provide the user with a means for removing nail polish from the thumb and multiple fingers of one hand simultaneously. To accomplish this, the opening of the nail polish remover container is separated into individual finger compartments to accommodate a thumb and four fingers of the user's hand. The insert incorporates a plurality of individual separated finger openings and associated semicylindrical finger supports and a semicylindrical thumb support which project downward into the interior of the chamber of the receptacle. These supports provide placement of the fingers and thumb against the respective individually mounted finger bristle liner member and the finger support.

These and other objects, advantages, and novel features of the present invention will become apparent when considered with the teachings contained in the detailed disclosure along with the accompanying drawings.

BRIEF DESCRIPTION OF THE DRAWINGS

FIG. 2 is top plan view of the insert of FIG. 1 installed in the container;

FIG. 3 is an enlarged side elevation view of a brush liner insert for each finger support member;

DETAILED DESCRIPTION OF PREFERRED EMBODIMENT

Figure 1:
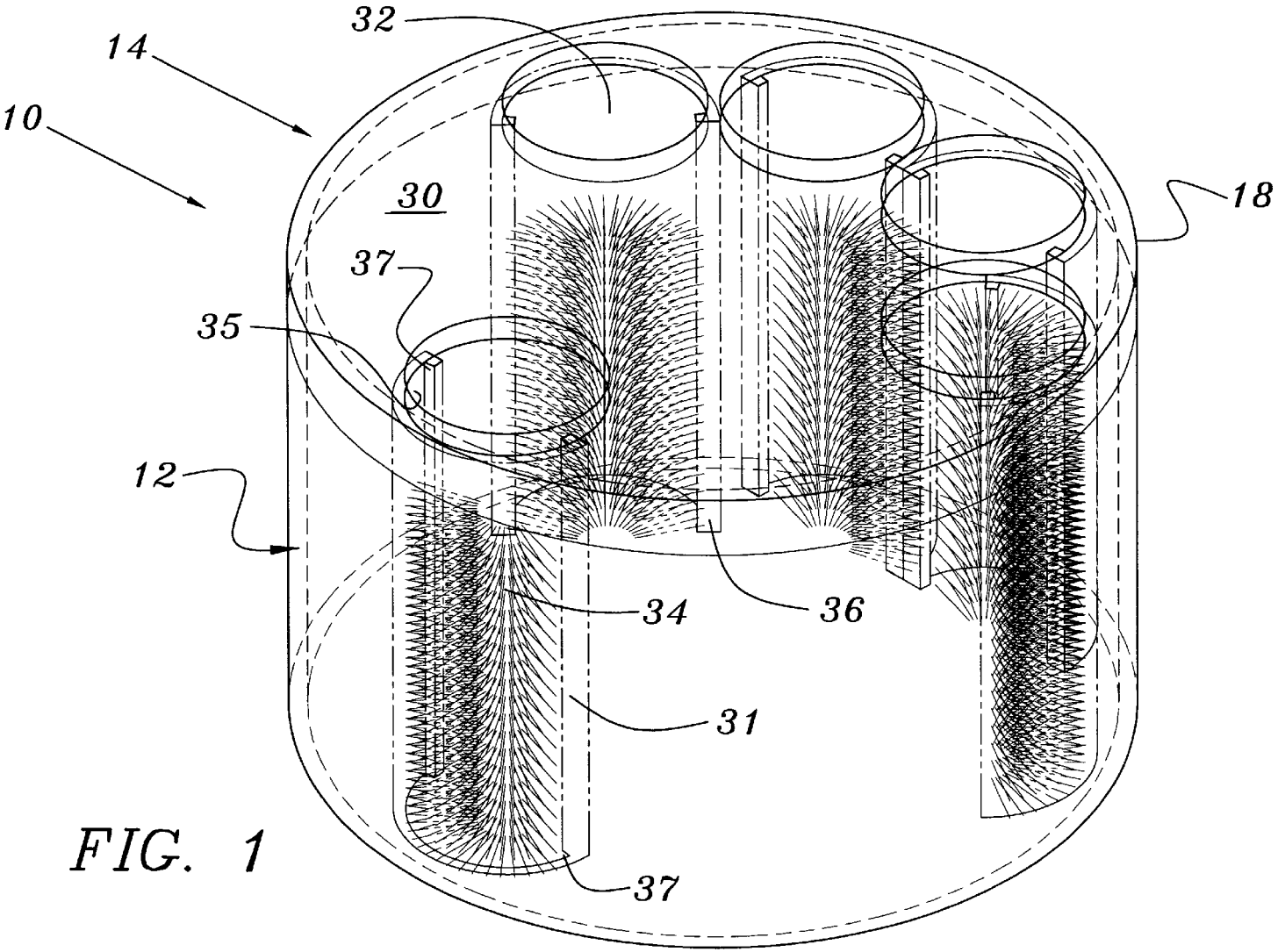
FIG. 1 is a perspective view of the nail polish remover insert partially in phantom mounted in the container showing positioning of the finger supports of the insert.
Figure 4:
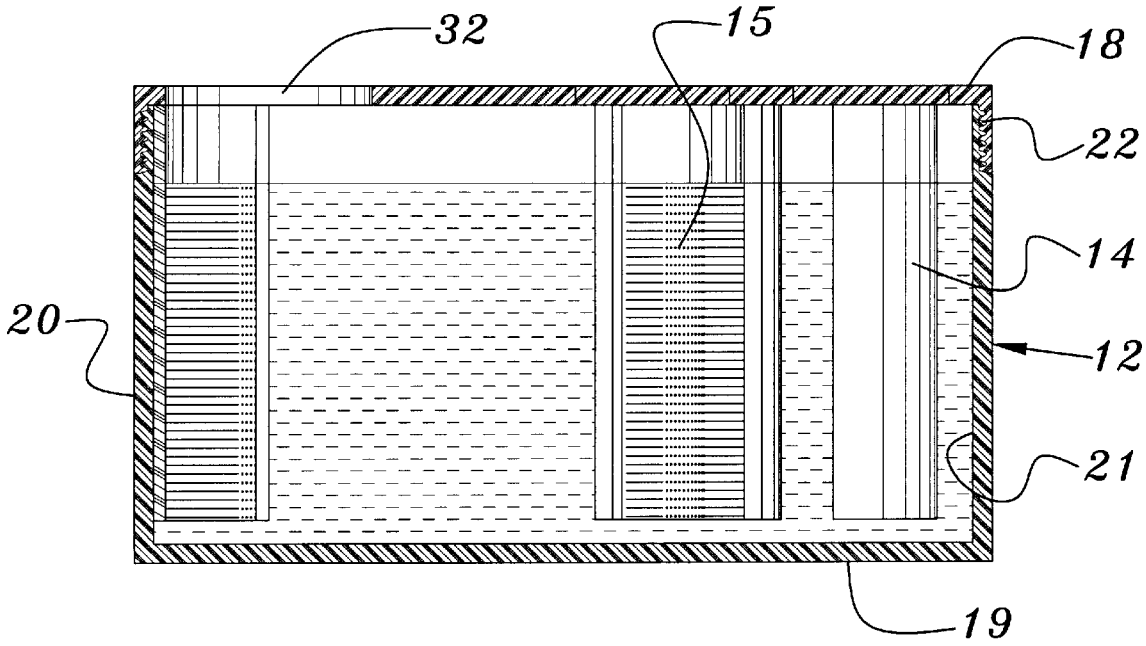
FIG. 4 is a cross sectional view of nail polish remover device with cap removed shown in FIG. 2 taken along line 4'—4' of FIG. 2.
Figure 5:
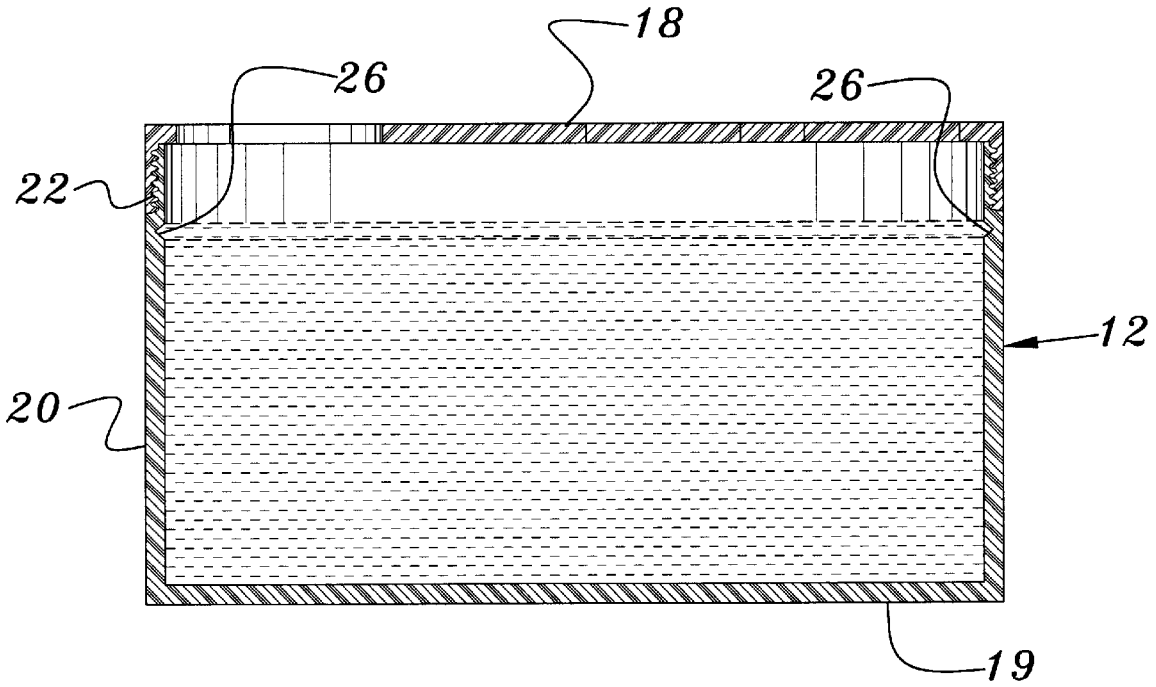
FIG. 5 is a cross sectional view of the container and cap without the insert.

The preferred embodiment and the best mode of the present invention is shown in FIGS. 1 through 4. As shown in the Figures, the inventive nail polish remover device is generally designated by the numeral 10 and comprises three basic pieces or parts: a cylindrical container 12, a finger support and brush insert 14 having an integrally molded top disk shaped support 30 with a plurality of downwardly projecting arcuate or semicylindrical finger and brush support members 34 and a threaded cap 18. The container 12 has a cylindrical wall 20 secured to base 19. The cylindrical wall forms a circular opening at the top or proximal end of the container 12 thereby allowing insertion of the finger and brush insert 14. The exterior outer surface of the cylindrical wall 20 is formed with threads 22 which engage and hold cap 18. The interior wall surface 21 of the cylindrical wall 20 can be provided with an annular insert groove 26 to receive a rib (not shown) on the disk shaped support member or the outer edge surface 31 of the disk shaped top support member 30 can be friction welded to the inner wall surface 21 of the cylindrical wall 20.

The finger support brush insert 14, is preferably molded of a high density polyurethane plastic and is constructed of a disk shaped top support member 30 provided with a plurality of throughgoing apertures 32 which form entry point for the fingers and thumb of the user. The apertures 32 are orientated on the support member so that the midpoint of each circular aperture generally falls on the circumference of a common circle. Semicylindrical finger support members 34 are integrally molded to the top support member 30 and positioned adjacent each aperture 30 to project downward into the interior chamber of the container 12 when the insert 14 is mounted in the container 12. The finger support members 34 are generally orientated with respect to the respective apertures so that the two middle finger support members 34(*a*) have the same orientation and the end finger support members 34(*b*) and 34(*c*) are positioned along an arc of the aperture having a different orientation ranging from 30 degrees to 60 degrees in difference from the middle finger support members. The thumb support 34(*d*) is orientated 180 degrees from the middle finger supports 34(*a*). A linear flange 36 is secured to each longitudinal end of the finger support member 34 and runs along the length of the finger support member 34 forming an angled inner recess 37 with the inner wall 35 of the support member 34. These angled inner recesses 37 of the support members receive the base end edges of the bristle liner member 15 within the opposing angled recesses 37 formed by the angled end flanges 36 of the support member. The bristle liner member 15 is a separately molded piece preferably of a flexible plastic material such as polyethylene or polypropylene, is of an appropriate size and shape to lay against the interior wall surface 35 of the finger support 34. The bristle liner 15 has a base 50 preferably with longitudinal side walls 51 having an angular side edge configuration which easily fits into the recesses 37 of the finger support member 34. A bristle section 52 extends outward from the base 50. It should be noted that throughout this description, reference to the structure of the finger support member also includes the structure of the thumb support member. The finger bristle member 15 bristle section 52 has rows of bristles 54 which extend inwardly in chamber 24 with the bristle ends forming an arc parallel to the aperture circumference. The bristle rows 54 are constructed of spaced rows of bristle pairs equally spaced along each row and are of equal length. The two bristles of each bristle pair are angularly positioned away from each other and form a V shaped spacing. Each bristle forms an angle which will intersect with the adjacent bristle of the adjacent bristle pair. The spaces between the pairs of bristles and between the rows of bristles allow the nail polish remover solvent placed within the chamber 24 of the container 12 to flow freely into the brush area. The brush surface thus is directly positioned across from the fingers and thumb recesses.

The finger support and brush insert 14 is made of a high density polyurethane or polypropylene plastic material that is preferably friction welded by standard means onto the inner surface of the container 12 which is of a low density plastic material.

Variations of the above preferred embodiment are contemplated by the inventor. The cap 18 in the illustrated best mode and preferred embodiment is secured to the container 12 by means of screw threads 22 as described above but other means of attaching the cap which are well-known in the art can be used.

In addition, bristles of different lengths, diameters, degrees of stiffness, and of various shapes and numbers may be used. For example, the tips of the bristles can be conical or pointed, rounded, flat, or chisel shaped. Each bristle blade has a generally triangular base and three flat surfaces. The bristles of the illustrated preferred embodiment are integrally formed with the liner 15 by molding them as one piece.

The device is designed so that it can be easily and economically fabricated by injection molding and the bristles can be integrally molded with the liner 14. The entire construction of the container 12 and cap 18 is preferably made from a flexible and resilient plastic material such as polyethylene or polypropylene.

In operation the container is filed with polish remover. The user inserts a plurality of fingers into the container chamber 24 and the finger aperture 32 where the fingernails come in contact with nail polish remover solvent and the tips of the bristles 52 extending into the container chamber. The fingernails are moved across the bristle rows 54 to score the painted surface, further aiding in the removal of the polish. Simultaneously, the respective thumb is placed in the thumb aperture engages bristle rows 54 in the same manner the fingernails engage their respective bristles. Upon the removal of the fingers from the nail polish remover device, the bristles revert to their original memory positions.

In the foregoing description, the invention has been described with reference to a particular preferred embodiment, although it is to be understood that specific details shown are merely illustrative, and the invention may be carried out in other ways without departing from the true spirit and scope of the following claims:

What is claimed is:

1. A nail polish remover device comprising:

a cylindrical container defining a top opening and a container chamber;

a integrally formed brush insert assembly mounted in said container comprising a disk shaped support member defining a plurality of finger openings, open arcuate brush support members mounted to said support member adjacent each said finger opening, each brush support member comprising means to hold a separate plastic brush member, one of said finger openings being positioned on the opposite side of said support member from said other finger openings to provide a thumb opening and a brush assembly mounted in each brush support member.

2. A nail polish remover device as claimed in claim 1 wherein said brush support member comprises a semicylindrical base member with inwardly extending side flanges extending along the longitudinal sides of said semicylindrical base member.

3. A nail polish remover device as claimed in claim 2 wherein each of said side flanges and an inner wall of said semicylindrical base member form an acute angle.

4. A nail polish remover device as claimed in claim 1 wherein said brush member comprises a rectangular flexible base member with a planar interior surface, and a plurality of bristles extending from said planar surface.

5. A nail polish remover device as claimed in claim 4 wherein said base member has two sides edges, each of which is configured in an acute angle.

6. A nail polish remover device comprising:

a cylindrical container with a base and wall means extending from said base defining a top opening and a container chamber;

an integrally formed brush insert assembly mounted in said container comprising a disk shaped support member defining a plurality of openings to receive the fingers and thumb of a user's hand, one of said finger openings being positioned away from said other finger openings to provide a thumb opening, a plurality of brush support members mounted to said support member and extending away from said support member into said container chamber, each of said brush support members being positioned adjacent to and aligned with each said opening and comprising a semicylindrical base member opening inward toward the center axis of said container chamber with inwardly extending side flanges along its length, each side flange and an inner wall of said semicylindrical base member forming an acute angle to hold a separate plastic brush member, said brush member comprising a flexible rectangular base with an edge of the longest side walls defining an acute angle which fits in the acute angle formed by said side flange and inner wall of said semicylindrical base member and a bristle assembly mounted to said brush support member.

7. A nail polish remover device as claimed in claim 6 where said insert assembly is integrally molded of a high density plastic material.

8. A nail polish remover device as claimed in claim 7 wherein said plastic material is polypropylene.

9. A nail polish remover device as claimed in claim 7 wherein said plastic material is polyethylene.

10. A nail polish remover device as claimed in claim 6 wherein said container is molded of low density plastic material and said insert is molded of high density plastic material.

11. A nail polish remover as claimed in claim 6 wherein said plurality of openings comprise at least four holes positioned so that the center points forming an arcuate line.

12. A nail polish remover device comprising:

a container comprising a cylindrical wall and a base secured to said cylindrical wall, said container defining a top opening and a chamber;

an integrally formed brush insert assembly secured in said container chamber, said insert assembly comprising a molded plastic disk shaped support member defining a plurality of circular openings adapted to receive the fingers and thumb of a user, said plurality of circular openings having their center points substantially aligned on the circumference of a circle, a plurality of brush support members integrally molded to said support member and extending away from said support member toward the base of said container, each of said brush support members being positioned adjacent each said opening and comprising a semicylindrical member with inwardly extending side flanges running along the length of said semicylindrical member, said side flanges and an inner wall of said semicylindrical member forming an acute angle to receive and hold a separate plastic brush member, each said plastic brush member comprising a base and a plurality of bristles extending from said base.

13. A nail polish remover device as claimed in claim 12 wherein said plastic brush member base has a length substantially equal to the length of said semicylindrical member and defines end edges formed in an acute angle to fit into the acute angle formed by a side flange and said inner wall of said semicylindrical base member.

14. A nail polish remover device as claimed in claim 12 wherein said plurality of openings comprise four adjacent openings and at least one opening distal from said four adjacent openings.

15. A nail polish remover device as claimed in claim 12 wherein said plurality of openings is five openings and two of said brush support members are positioned respective to the adjacent opening in the same orientation and the other three brush support members are positioned respective to the adjacent opening in a different orientation than said two brush support members.

16. A nail polish remover device as claimed in claim 14 wherein said four adjacent openings have the two middle adjacent openings with brush support members positioned in the same orientation with respect to the adjacent opening and the opening at each end of the four adjacent openings is provided with a brush support member positioned in a different orientation from that of the middle two brush support members.

17. A nail polish remover device as claimed in claim 16 including a distal opening which has a brush support member positioned in a reverse orientation from that of the middle two brush support members.

18. A nail polish remover device as claimed in claim 12 wherein said brush member comprises a rectangular flexible base member with a planar interior surface, and a plurality of bristles extending from said planar surface.

19. A nail polish remover device as claimed in claim 12 wherein said container is molded of low density plastic and said insert is molded of high density plastic with said container and insert being friction welded together.

* * * * *